US008713726B1

(12) United States Patent
Erdman et al.

(10) Patent No.: US 8,713,726 B1
(45) Date of Patent: May 6, 2014

(54) PIVOTING HINGE FOR NO-TOOL ASSEMBLY OF A CONVERTIBLE SOFA

(71) Applicants: Thomas C. Erdman, Fort Atkinson, WI (US); Steve E. Connor, Wheeling, IL (US); Mo J. Lin, Zhenjiang (CN)

(72) Inventors: Thomas C. Erdman, Fort Atkinson, WI (US); Steve E. Connor, Wheeling, IL (US); Mo J. Lin, Zhenjiang (CN)

(73) Assignee: Handy Button Machine Co., Wheeling, IL (US)

( * ) Notice: Subject to any disclaimer, the term of this patent is extended or adjusted under 35 U.S.C. 154(b) by 0 days.

(21) Appl. No.: 13/796,380

(22) Filed: Mar. 12, 2013

Related U.S. Application Data

(60) Provisional application No. 61/612,066, filed on Mar. 16, 2012.

(51) Int. Cl.
*A47C 17/17* (2006.01)

(52) U.S. Cl.
USPC ..... 5/57.1; 5/51.1; 5/47; 5/16; 5/12.1

(58) Field of Classification Search
CPC ..... A47C 17/1756; A47C 17/16; A47C 17/17
USPC ..... 5/12.1, 16, 20, 32.1, 37.1, 47, 51.1, 5/57.1
See application file for complete search history.

(56) References Cited

U.S. PATENT DOCUMENTS

| | | | | | |
|---|---|---|---|---|---|
| 2,437,949 | A * | 3/1948 | Fox et al. | ..... | 5/47 |
| 2,447,683 | A * | 8/1948 | Boiu | ..... | 5/47 |
| 2,493,096 | A * | 1/1950 | Wilson | ..... | 5/47 |
| 2,495,413 | A * | 1/1950 | Harman | ..... | 5/47 |
| 2,539,812 | A * | 1/1951 | Carrick | ..... | 5/57.1 |
| 2,601,683 | A * | 7/1952 | Bebry et al. | ..... | 5/57.1 |
| 2,627,613 | A * | 2/1953 | Lund | ..... | 5/47 |
| 2,651,054 | A * | 9/1953 | Krakauer | ..... | 5/47 |
| 3,107,364 | A * | 10/1963 | Simmons | ..... | 5/41 |
| 3,247,527 | A * | 4/1966 | Mizelle | ..... | 5/57.1 |
| 3,913,152 | A * | 10/1975 | Quakenbush | ..... | 5/37.1 |
| 4,048,680 | A * | 9/1977 | Rogers, Jr. | ..... | 5/37.1 |
| 6,738,997 | B2 * | 5/2004 | Patella | ..... | 5/37.1 |

* cited by examiner

*Primary Examiner* — Nicholas Polito
*Assistant Examiner* — David R Hare
(74) *Attorney, Agent, or Firm* — Marshall, Gerstein & Borun LLP

(57) ABSTRACT

A hinge assembly includes a linkage base adapted to be secured to a portion of a furniture sidewall, an elongate first linkage arm, and an elongate second linkage arm. The hinge assembly may also include an insert member assembly that includes an elongate first insert member, an elongate second insert member, a pivot assembly to pivotably couple the first insert member to the second insert member, and an insert linkage arm that is coupled to the first insert member. The first linkage arm and the second linkage arm are each pivotally coupled to the linkage base and the insert linkage arm. The first insert member may be releasably coupled to a first rear receiving member secured to a first furniture portion and the second insert member may be releasably coupled to a first front receiving member secured to a second furniture portion.

20 Claims, 8 Drawing Sheets

PIVOTING HINGE FOR NO-TOOL ASSEMBLY OF A CONVERTIBLE SOFA

REFERENCE TO RELATED APPLICATIONS

This is a non-provisional and claims the benefit of the filing date of U.S. provisional application No. 61/612,066, filed Mar. 16, 2012. The entire disclosure of U.S. provisional application No. 61/612,066 is incorporated herein by reference.

FIELD OF THE DISCLOSURE

This disclosure relates generally to furniture, and, more particularly, to a pivoting hinge for use with a convertible sofa that does not require tools for assembly.

BACKGROUND

There has been a growing trend for large furniture items, such as sofas (or couches), to be shipped to an end-user in a disassembled state to minimize shipping volume. Often, tools (such as screwdrivers, Allen wrenches, or mallets) are required to assemble the components of the sofa. However, the requirement to use tools typically inconveniences the end-user. For example, the end-user may not have the necessary tools, or the fastening members (such as screws) may be small and difficult to insert or tighten. In the past, manufacturers have provided tools with the fastening members, but such provided tools (such as an Allen wrench or a stamped, open-ended wrench) increase costs, may be difficult to handle, and may be lost in transit or by the end-user among the packaging materials. In addition, the tools (or one or more of the fastening members) may be accidentally omitted from the product packaging, thereby frustrating the end-user and requiring customer service support to coordinate the shipment of replacement parts to the end user. Consequently, it would be desirable to provide no-tool assembly sofas that, as the name suggests, allows the end-user to assemble the sofa without the use of tools. In the past, however, sofas assembled without tools lack the ability to convert from a sitting position to a sleeping position. Accordingly, there is a need for a hinge component for a convertible sofa that can be assembled by an end-user without the use of tools, while allowing for the conversion of the sofa from a sleeping position to one or more seating positions.

BRIEF SUMMARY OF THE DISCLOSURE

A hinge assembly includes a linkage base that is adapted to be secured to a portion of a furniture sidewall. The hinge assembly also includes an elongate first linkage arm and an elongate second linkage arm. The hinge assembly may also include an insert member assembly that includes an elongate first insert member, an elongate second insert member, and a pivot assembly disposed adjacent to a second end of the first insert member and a second end of the second insert member such that the pivot assembly pivotably couples the first insert member to the second insert member. The insert member assembly may also include an insert linkage arm that is coupled to the first insert member. A first end of the first linkage arm is pivotably coupled to a first portion of the linkage base and a second end of the first linkage arm is pivotably coupled to a first portion of the insert linkage arm. In addition, a first end of the second linkage arm is pivotably coupled to a second portion of the linkage base and a second end of the second linkage arm is pivotably coupled to a second portion of the insert linkage arm. The first insert member of the hinge assembly may be releasably coupled to a first rear receiving member secured to a first furniture portion and the second insert member of the hinge assembly may be releasably coupled to a first front receiving member secured to a second furniture portion. A second hinge assembly, that may be a minor image of (but otherwise identical to) the hinge assembly, may be secured to a second furniture sidewall such that a first insert member of the second hinge assembly may be releasably coupled to a second rear receiving member secured to the first furniture portion and a second insert member of the second hinge assembly may be releasably coupled to a second front receiving member secured to the second furniture portion.

So assembled, the first furniture portion may be secured to the first hinge assembly and the second hinge assembly and the second furniture portion may be secured to the first hinge assembly and the second hinge assembly such that the first furniture portion is pivotable relative to the second furniture portion about a pivot axis of the pivot assembly. Configured as described, the first and second hinge assemblies may provide for a convertible sofa that is assembled without tools, the first and second convertible hinge assemblies having a first position in which the first furniture portion and the second furniture portion are substantially aligned in the same plane to form a sleeping position and a second position in which the first furniture portion and the second furniture portion are disposed at a right (or an obtuse) angle to form a seating position.

DETAILED DESCRIPTION

Figure 1A:
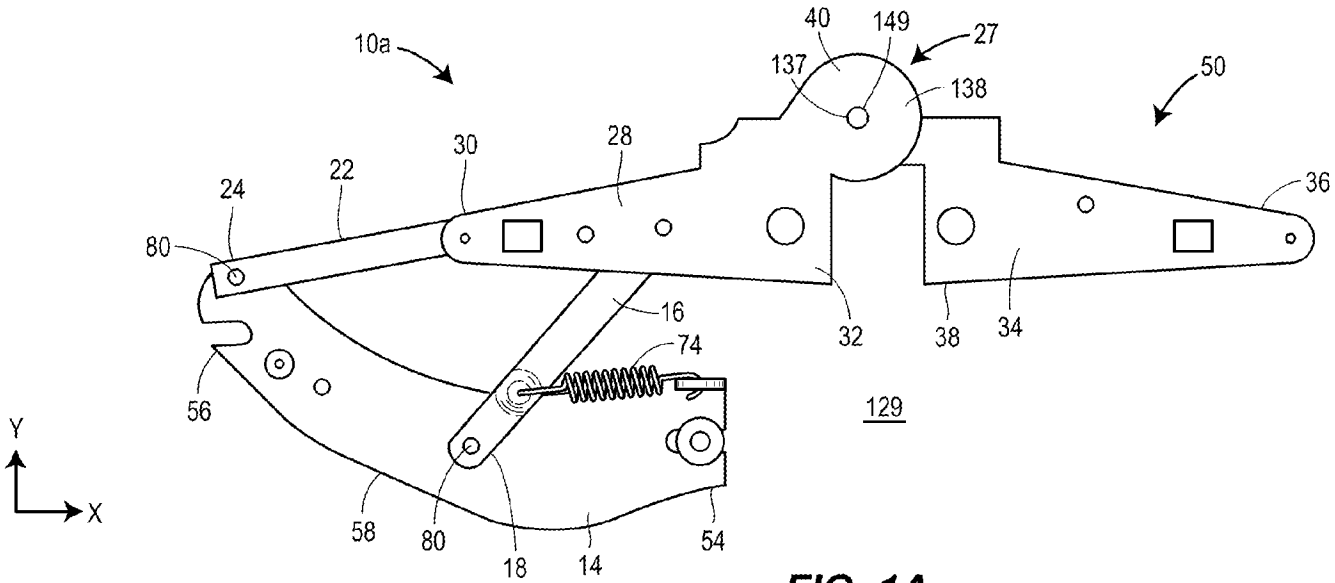
FIG. 1A is a front plan view of an embodiment of an insert member assembly coupled to a linkage base of a hinge assembly, with the linkage base mounted to a furniture sidewall.
Figure 1B:
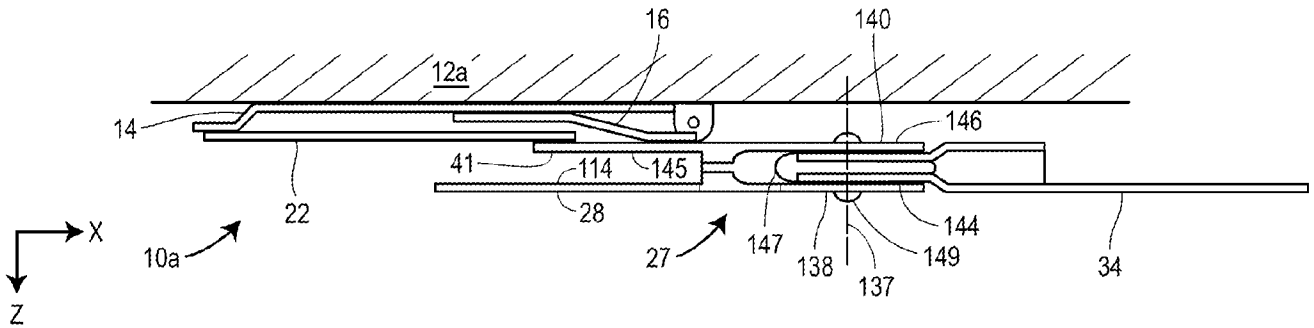
FIG. 1B is a top view of the embodiment of the hinge assembly illustrated in FIG. 1A.
Figure 6:
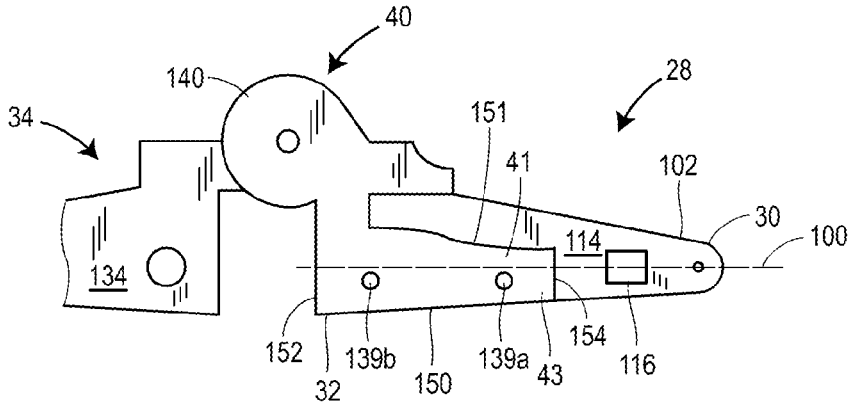
FIG. 6 is a rear plan view of the first insert member of the insert member assembly illustrated in FIG. 5.
Figure 18:
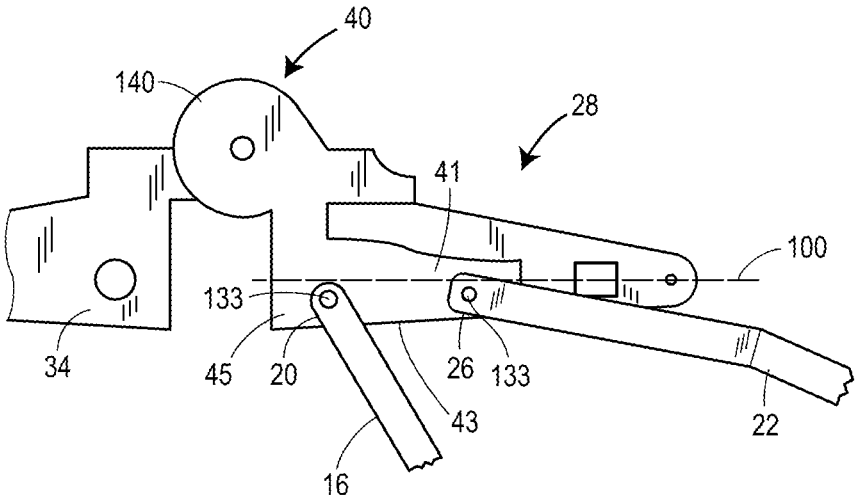
FIG. 18 is a partial rear plan view of the first insert member of the insert member assembly illustrated in FIG. 5 that is coupled to the first linkage arm and the second linkage arm.

As illustrated in FIG. 1A, a hinge assembly 10*a* is adapted to be coupled to a furniture sidewall 12*a*, and the hinge assembly 10*a* includes a linkage base 14 adapted to be secured to a portion of the furniture sidewall 12*a*. The hinge assembly 10*a* also includes an elongate first linkage arm 16 having a first end 18 and a second end 20 opposite the first end 18 and an elongate second linkage arm 22 having a first end 24 and a second end 26 opposite the first end 24. The hinge assembly 10*a* additionally includes an insert member assembly 27 including an elongate first insert member 28 having a first end 30 and a second end 32 opposite the first end 30 and an elongate second insert member 34 having a first end 36 and a second end 38 opposite the first end 36. The insert member assembly 27 also includes a pivot assembly 40 disposed adjacent to the second end 32 of the first insert member 28 and the second end 38 of the second insert member 34 such that the pivot assembly 40 pivotably couples the first insert member 28 to the second insert member 34. As illustrated in FIGS. 1B, 6, and 18, the insert member assembly 27 further includes an insert linkage arm 41 having a first end 43 and a second end 45 opposite the first end 43, and the insert linkage arm 41 is coupled to the first insert member 28. Referring to FIGS. 1A and 1B, the first end 18 of the first linkage arm 16 is pivotably coupled to a first portion of the linkage base 14 and the second end 20 of the first linkage arm 16 is pivotably coupled to a first portion of the insert linkage arm 41. In addition, the first end 24 of the second linkage arm 22 is pivotably coupled to a second portion of the linkage base 14 and the second end 26 of the second linkage arm 22 is pivotably coupled to a second portion of the insert linkage arm 41.

Figure 14:
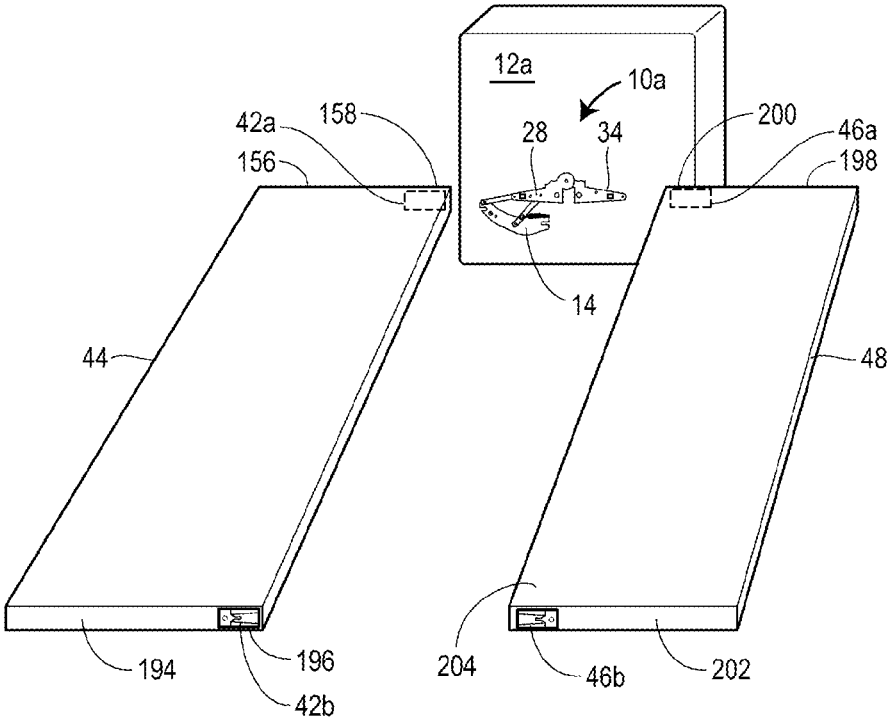
FIG. 14 is an isometric view of the first furniture portion and the second furniture portion aligned with the first insert member and the second insert member, respectively, with the second furniture sidewall omitted for clarity.
Figure 15:
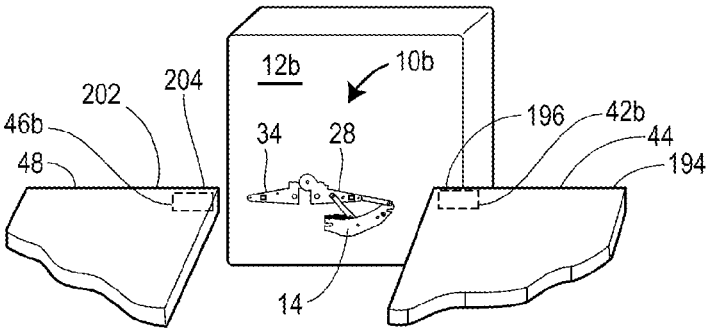
FIG. 15 is a partial isometric view of a second furniture sidewall and a second hinge assembly with the first furniture portion and the second furniture portion aligned with the first insert member and the second insert member, respectively.

Referring to FIG. 14, the first insert member 28 of the hinge assembly 10*a* may be releasably coupled to a first rear receiving member 42*a* secured to a first furniture portion 44 and the second insert member 34 of the hinge assembly 10*a* may be releasably coupled to a first front receiving member 46*a* secured to a second furniture portion 48. As illustrated in FIG. 15, a second hinge assembly 10*b*, that is a mirror image of (but otherwise identical to) the first hinge assembly 10*a*, may be secured to a second furniture sidewall 12*b* such that a first insert member 28 of the second hinge assembly 10*b* may be releasably coupled to a second rear receiving member 42*b* secured to the first furniture portion 44 and a second insert member 34 of the second hinge assembly 10*b* may be releasably coupled to a second front receiving member 46*b* secured to the second furniture portion 48.

Figure 16:
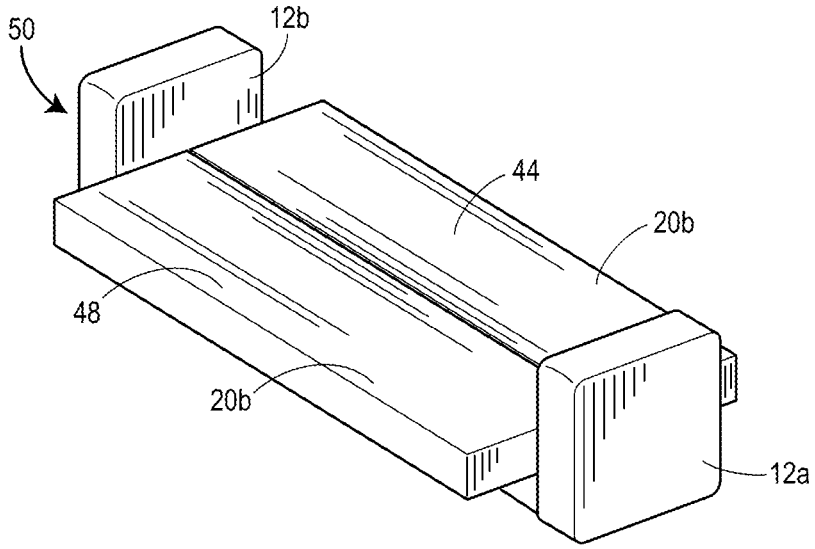
FIG. 16 is an isometric view of a convertible sofa in a sleeping position.
Figure 17:
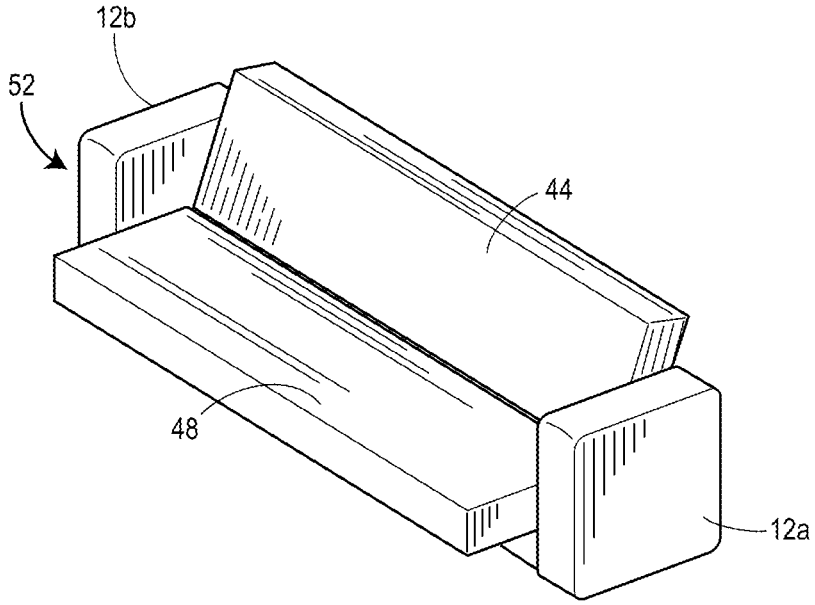
FIG. 17 is an isometric view of the convertible sofa of FIG. 16 in a seating position.

So assembled, the first furniture portion 44 (which may be a seat back portion of a convertible sofa) may be secured to the first hinge assembly 10*a* (which may be non-releasably secured to the furniture sidewall 12*a*, such as a lateral arm of a convertible sofa) and the second hinge assembly 10*b* (which may be non-releasably secured to the second furniture sidewall 12*b*, such as a second lateral arm of a convertible sofa) and the second furniture portion 48 (which may be a seat bottom portion of a convertible sofa) may be secured to the first hinge assembly 10*a* and the second hinge assembly 10*b* such that the first furniture portion 44 is pivotable relative to the second furniture portion 48 about a pivot axis of the pivot assembly 40, as illustrated in FIG. 17. Configured as described, the first and second hinge assemblies 10*a*, 10*b* may provide for a convertible sofa that is assembled without tools, the first and second convertible hinge assemblies 10*a*, 10*b* having a first position 50 (illustrated in FIGS. 1A and 16) in which the first furniture portion 44 and the second furniture portion 48 are substantially aligned in the same plane to form a sleeping position and a second position 52 (illustrated in FIGS. 11 and 17) in which the first furniture portion 44 and the second furniture portion 48 are disposed at a right (or an obtuse) angle to form a seating position. Such a convertible sofa has a minimal amount of parts to be assembled. In addition, the convertible sofa requires no fastening members (such as screws) that could make assembly difficult for the end-user or that could inconvenience the end-user by being lost or misplaced.

Figure 2:
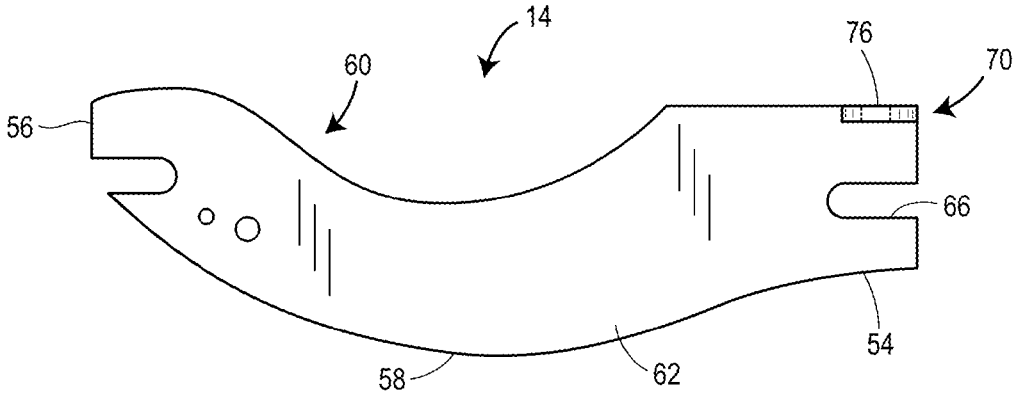
FIG. 2 is a front plan view of a linkage base of the embodiment of the hinge assembly illustrated in FIG. 1A.
Figure 3:
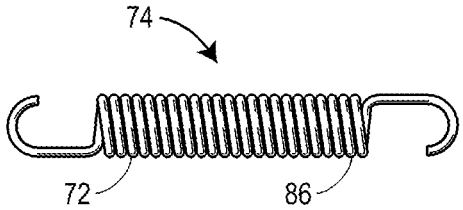
FIG. 3 is a front plan view of a coil spring of the embodiment of the hinge assembly illustrated in FIG. 1A.

Turning the hinge assembly 10*a* in more detail, the hinge assembly 10*a* may include the linkage base 14 that may be fixedly secured to the first furniture sidewall 12*a*, as illustrated in FIGS. 1A and 2. The linkage base 14 may have any suitable shape or combinations of shapes. For example, the linkage base 14 may have an elongated, slightly arcuate shape having a first end 54, a second end 56 opposite the first end 54, and an intermediate portion 58 disposed between the first end 54 and the second end 56. The linkage base 14 may be planar or substantially planar, and the linkage base 14 may have a first surface 60 adapted to be adjacent to or in contact with an inner surface of the first furniture sidewall 12*a*. A second surface 62 may be opposite the first surface 60. The linkage base 14 may also have an attachment feature 70 adapted to secure a first end 72 of a coil spring 74 (illustrated in FIGS. 1A and 3). For example, the attachment feature 70 may be a planar flange portion 76 disposed at or adjacent to a top portion of the first end 54 of the linkage base 14, and the flange portion 76 may have an aperture adapted to receive a portion of the first end 72 of the coil spring 74.

While the example linkage base 14 is illustrated as being a single, unitary part, the linkage base 14 may instead be an assembly of two or more component parts, and any or all of the two or more component parts may be secured to the first furniture sidewall 12*a* such that the component parts are not in mutual contact. That is, a first component part of the linkage base 14 may include the second portion of the linkage base 14 (e.g., the second end 56), and this first component part may be spaced from a second component part of the linkage base 14 that may include the first portion of the linkage base 14 (e.g., intermediate portion 58).

As illustrated in FIG. 2, one or more apertures 66 or slots may be formed in the linkage base 14 to receive screws or rivets that secure the linkage base 14 to the first furniture sidewall 12*a* in a manner that is known in the art. Instead of using screws of rivets, the linkage base 14 may be secured to the first furniture sidewall 12*a* in any manner known in the art. The linkage base 14 may be secured to the first furniture sidewall 12*a* at the manufacturing facility or at any time prior to shipping the unassembled product to a retail outlet or to an end-user.

Referring to FIGS. 1A, 1B, 4A, and 4B, the hinge assembly 10*a* may include the first linkage arm 16. The first linkage arm 16 may be elongated and may extend along a longitudinal axis 78 such that the first linkage arm 16 includes the first end 18 and a second end 20 longitudinally opposite the first end 18. The first end 18 of the first linkage arm 16 may be pivotably coupled to a first portion of the linkage base 14. For example, the first end 18 may be pivotably coupled to the intermediate portion 58 of the linkage base 14. The first end 18 may be pivotably coupled to the first portion of the linkage base 14 in any manner known in the art. For example, a pin 80 may be disposed through corresponding apertures formed at or adjacent to the first end 18 of the first linkage arm 16 and at or adjacent to the intermediate portion 58 of the linkage base 14. The first end 18 may be pivotably coupled to the first portion of the linkage base 14 at the manufacturing facility or at any time prior to shipping the unassembled product to a retail outlet or to an end-user. The second end 20 of the first linkage arm 16 may be pivotably coupled to the first portion of the insert linkage arm 41 of the insert member assembly 27 in a manner that will be described in more detail below.

Figure 4A:
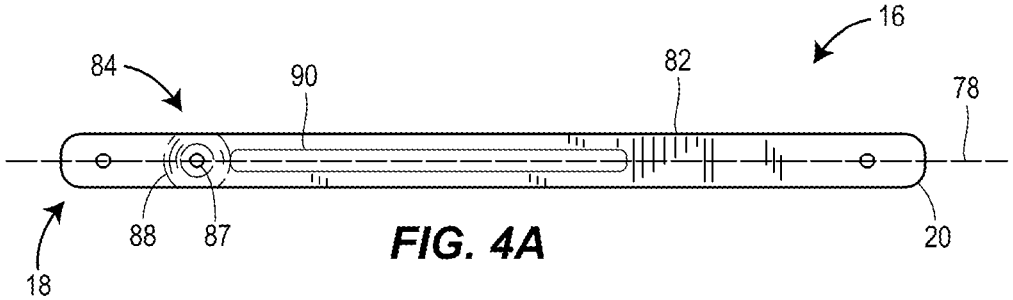
FIG. 4A is a front plan view of a first linkage arm of the embodiment of the hinge assembly illustrated in FIG. 1A.
Figure 4B:
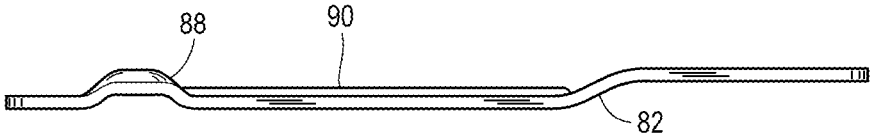
FIG. 4B is a side view of the first linkage arm illustrated in FIG. 4A.

The first linkage arm 16 may be planar or substantially planar or may have one or more portions that are mutually non-planar. For example, an oblique, planar transition portion 82 may be disposed between the first end 18 and the second end 20, and a portion of the first linkage arm 16 between the transition portion 82 and the first end 18 may be planar and a portion of the first linkage arm 16 between the transition portion 82 and the second end 20 may be planar, as illustrated in FIG. 4B. An engagement feature 84 may be disposed on the first linkage arm 16 at any suitable location, and the engagement feature 84 may be adapted to secure a second end 86 of a coil spring 74 (illustrated in FIG. 3). For example, the engagement feature 84 may be an aperture 87 disposed on a protrusion 88 formed on the first linkage arm 16 between the first end 18 and the transition portion 82, and the aperture 87 may be adapted to receive a portion of the second end 86 of the coil spring 74. A longitudinally-extending groove 90 may be formed in the first linkage arm 16 to provide resistance against bending or other structural deformation.

Figure 8A:
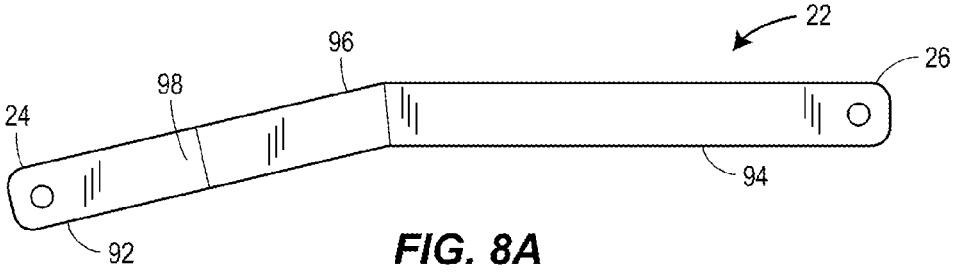
FIG. 8A is a front plan view of a second linkage arm of the embodiment of the hinge assembly illustrated in FIG. 1A.
Figure 8B:
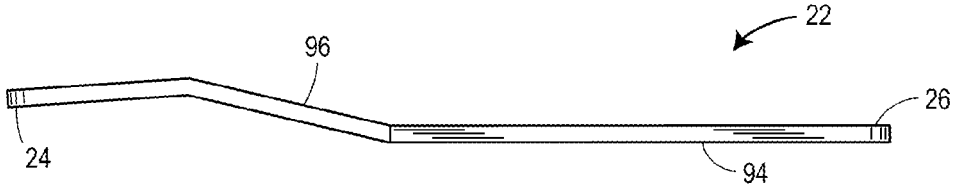
FIG. 8B is a side view of the second linkage arm illustrated in FIG. 4A.

Referring to FIGS. 1A, 1B, 8A, and 8B, the hinge assembly 10*a* may include the second linkage arm 22. The second linkage arm 22 may be elongated and may include a first portion 92 and a second portion 94 that are disposed at an oblique angle when viewed along a vertical axis (i.e., an axis parallel to the Z-axis of the reference coordinate system provided in FIGS. 1A and 1B). The second linkage arm 22 may include the first end 24 and the second end 26 longitudinally opposite the first end 24. The first end 24 of the second linkage arm 22 may be pivotably coupled to the second portion of the linkage base 14 (e.g., the second end 56 of the linkage base 14). The first end 24 may be pivotably coupled to the second portion of the linkage base 14 in the same manner in which the first end 18 is pivotably coupled to the first portion of the linkage base 14. The first end 24 may be pivotably coupled to the second portion of the linkage base 14 at the manufacturing facility or at any time prior to shipping the unassembled product to a retail outlet or to an end-user. The second end 26 of the second linkage arm 22 may be pivotably coupled to the second portion of the insert linkage arm 41 of the insert member assembly 27 in a manner that will be described in more detail below. As illustrated in FIGS. 8A and 8B, the second linkage arm 22 may be planar or substantially planar or may have one or more portions that are mutually non-planar. For example, an oblique, planar transition portion 96 may be disposed between the first end 24 and the second end 26. A portion of the second linkage arm 22 between the transition portion 96 and the first end 24 may be planar and a portion of the second linkage arm 22 between the transition portion 96 and the second end 26 may be planar. A longitudinally-extending groove 98 may be formed in the second linkage arm 22 to provide resistance against bending or other structural deformation.

Figure 5:
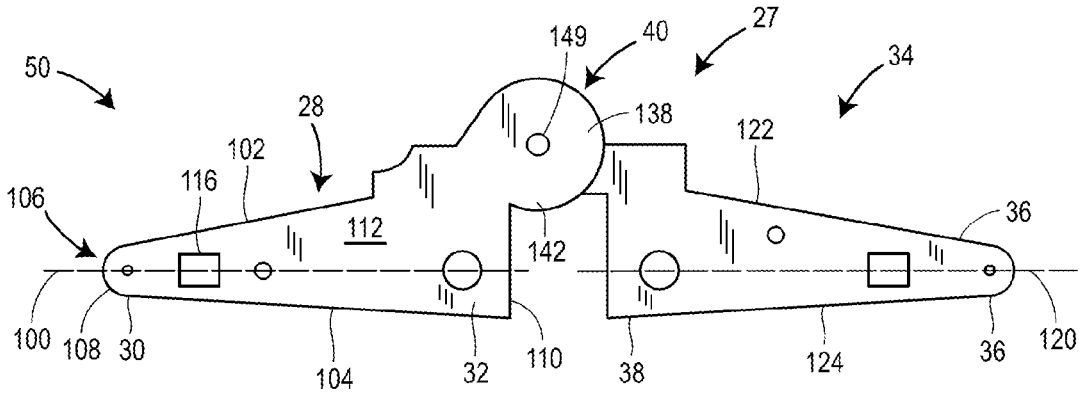
FIG. 5 is a front plan view of an insert member assembly of the embodiment of the hinge assembly illustrated in FIG. 1A.

Referring to FIGS. 1A, 1B, and 5, the hinge assembly 10*a* may include the insert member assembly 27, and the insert member assembly 27 may include the first insert member 28, the second insert member 34, the pivot assembly 40, and the insert linkage arm 41. As illustrated in FIGS. 5 and 6, the first insert member 28 may be elongate and may extend along a longitudinal axis 100 such that the first insert member 28 includes the first end 30 and the second end 32 longitudinally opposite the first end 30. The first insert member 28 may be planar and may be defined by a first lateral edge 102 and a second lateral edge 104 that each extend from the first end 30 to the second end 32, and the first lateral edge 102 and the second lateral edge 104 may each converge towards the longitudinal axis 100 as the first lateral edge 102 and the second lateral edge 104 each extends from the second end 32 towards the first end 30 of the first insert member 28. The first lateral edge 102 and the second lateral edge 104 may be linear or substantially linear, or the first lateral edge 102 and the second lateral edge 104 may be curved relative to the longitudinal axis 100. The first lateral edge 102 and the second lateral edge 104 may be symmetrical or substantially symmetrical about the longitudinal axis 100. However, the first lateral edge 102 and the second lateral edge 104 (or portions of one or both of the first lateral edge 102 and the second lateral edge 104) may be asymmetrical about the longitudinal axis 100.

Referring to FIG. 5, the first insert member 28 may also include a nose portion 106 disposed at or adjacent to the first end 30 of the first insert member 28. The nose portion 106 may be at least partially defined by a nose edge 108 that extends between the first lateral edge 102 and the second lateral edge 104, and the nose edge 108 may be rounded or contoured. The first insert member 28 may be further defined by a transverse edge 110 that upwardly extends from the second lateral edge 104 at or adjacent to the second end 32 towards the pivot assembly 40 secured to the second end 32 of first insert member 28. As explained above, the first insert member 28 may be planar and may have a first surface 112 (illustrated in FIG. 5) facing away from the first furniture sidewall 12*a* and a second surface 114 (illustrated in FIG. 6) facing towards the first furniture sidewall 12*a*. The first insert member 28 may include a locking aperture 116, and the locking aperture 116 may have any suitable shape or location to receive a portion of corresponding locking tab 118 of the first rear receiving member 42*a* (illustrated in FIG. 9) to removably secure the first insert member 28 within the first rear receiving member 42*a* in a manner that will be described in more detail below. For example, the locking aperture 116 may be disposed between the first end 30 and the second end 32 of the first insert member 28, and the locking aperture 116 may have a square (or rectangular) shape that is symmetrically formed about the longitudinal axis 100.

Referring to FIGS. 1A, 1B, 5, and 7, the insert member assembly 27 of the hinge assembly 10*a* may include the second insert member 34, and the second insert member 34 may be substantially similar or identical to the first insert member 34. However, the second insert member 34 may have one or more dimensions that are smaller than the first insert member 34. The second insert member 34 may be elongate and may extend along a longitudinal axis 120 such that the second insert member 34 includes the first end 36 and the second end 38 longitudinally opposite the first end 36. The second insert member 34 may be planar and may be defined by a first lateral edge 122 and a second lateral edge 124 that extend from the first end 36 to the second end 38, and the first lateral edge 122 and the second lateral edge 124 may each converge towards the longitudinal axis 120 as the first lateral edge 122 and the second lateral edge 124 each extends from the second end 38 towards the first end 36 of the second insert member 34. The first lateral edge 122 and the second lateral edge 124 may be linear or substantially linear, or the first lateral edge 122 and the second lateral edge 124 may be curved relative to the longitudinal axis 120. The first lateral edge 122 and the second lateral edge 124 may be symmetrical or substantially symmetrical about the longitudinal axis 120. However, the first lateral edge 122 and the second lateral edge 124 (or portions of one or both of the first lateral edge 122 and the second lateral edge 124) may be asymmetrical about the longitudinal axis 120.

The second insert member 34 may also include a nose portion 126 disposed at or adjacent to the first end 36 of the second insert member 34. The nose portion 126 may be at least partially defined by a nose edge 128 that extends between the first lateral edge 122 and the second lateral edge 124, and the nose edge 128 may be rounded or contoured. The second insert member 34 may be further defined by a transverse edge 130 that upwardly extends from the second lateral edge 124 at or adjacent to the second end 38 towards the hinge portion 40 secured to the second end 38 of second insert member 34. As explained above, the second insert member 34 may be planar and may have a first surface 132 facing away from the first furniture sidewall 12*a* and a second surface 134 facing towards the first furniture sidewall 12*a*. The second insert member 34 may include a locking aperture 136 that may be identical in function to the locking aperture 116 previously described. The locking aperture 136 may be disposed between the first end 36 and the second end 38 of the second insert member 34, and the locking aperture 136 may have a square (or rectangular) shape that is symmetrically formed about the longitudinal axis 120.

Referring to FIGS. 1A, 1B, 5, and 6, the insert member assembly 27 of the hinge assembly 10*a* may also include the pivot assembly 40. The pivot assembly 40 may include any structure or combination of structures that allows the first insert member 28 to pivot relative to the second insert member 34 about a pivot axis 137 that is vertical (i.e., disposed parallel to the Z-axis of the reference coordinate system provided in FIGS. 1A and 1B). For example, the pivot assembly 40 may include a planar first end plate 138 and a planar second end plate 140 vertically offset from the first end plate 138, and a bottom wall 142 may extend between a bottom portion of the first end plate 138 and a bottom portion of the second end plate 140. The portion of the bottom wall 142 adjacent to the first end plate 138 may be secured to a top portion of the second end 32 of the first insert member 28 by any means known in the art, such as welding or mechanical fastening. So secured, a rear portion of each of the first end plate 138 and the second end plate 140 may extend beyond the transverse edge 110 of the first insert member 28.

Figure 7:
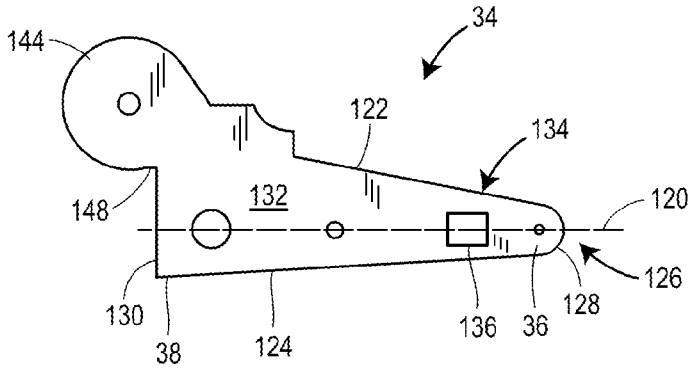
FIG. 7 is a front plan view of the second insert member of the insert member assembly illustrated in FIG. 5.
Figure 12:
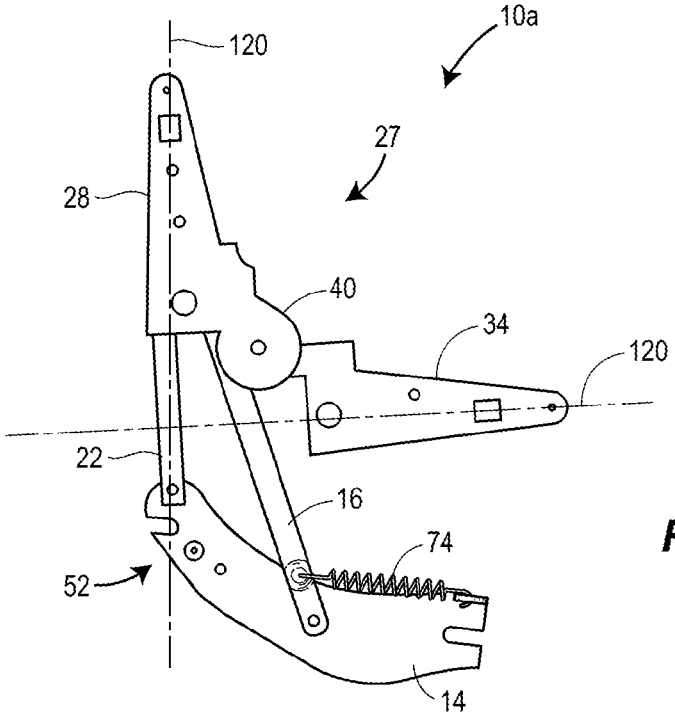
FIG. 12 is a front plan view of the embodiment of the hinge assembly illustrated in FIG. 1A in a second position.

As illustrated in FIGS. 1B and 7, the pivot assembly 40 may also include a planar third end plate 144 and a planar fourth end plate 146 offset from the third end plate 144, and a bottom wall 148 may extend between a bottom portion of the third end plate 144 and a bottom portion of the fourth end plate 146. The portion of the bottom wall 148 adjacent to the third end plate 138 may be secured to a top portion of the second end 38 of the second insert member 34 by any means known in the art, such as welding or mechanical fastening. So secured, a rear portion of each of the third end plate 144 and the fourth end plate 146 may extend beyond the transverse edge 130 of the second insert member 34. The vertical distance between the outer surfaces of the third end plate 144 and the fourth end plate 146 of the second insert member 34 may be slightly smaller than the vertical distance between the inner surfaces of the first end plate 138 and the second end plate 140 of the first insert member 28 such that the third end plate 144 and the fourth end plate 146 are disposed between the first end plate 138 and the second end plate 140. So disposed, each of the first, second, third, and fourth end plates 138, 140, 144, 146 may have an aperture (not shown) disposed therethrough, and the apertures may be coaxially aligned along the pivot axis 137. A pin 149 (such as a rivet) may be disposed through the apertures such that the first insert member 28 and the second insert member 34 may each rotate about the pivot axis 137 that is coaxially aligned with a longitudinal axis of the pin 149. Accordingly, the first insert member 28 may be pivotably coupled to the second insert member 34. A locking mechanism (shown generally as 147 in FIG. 1B) may be disposed between the third end plate 144 and the fourth end plate 146, and the locking mechanism 147 may allow the first insert member 28 and the second insert member 34 to be selectively locked in one or more desired positions (such as a first position 50 and/or a second position 52 illustrated in FIGS. 1A and 12, respectively) that will be described in more detail below.

Referring to FIGS. 1B, 6, and 18, the insert member assembly 27 of the hinge assembly 10*a* may also include the insert linkage arm 41 that may be coupled to the first insert member 28. The insert linkage arm 41 may be elongated and may extend parallel to the longitudinal axis 100 of the first insert member 28 such that the insert linkage arm 41 includes the first end 43 and the second end 45 longitudinally opposite the first end 43. The insert linkage arm 41 may be planar and may be vertically offset from the second surface 114 of the first insert member 28. The insert linkage arm 41 may be defined by a bottom lateral edge 150 that may be aligned with the second lateral edge 104 of the first insert member 28 (when viewed along a vertical axis). The insert linkage arm 41 may be further defined by a top lateral edge 151 that may be disposed adjacent to the longitudinal axis 100 when viewed along a vertical axis, and the top lateral edge 151 may be irregularly curved or otherwise contoured. The insert linkage arm 41 may also have a back edge 152 that is substantially aligned with the transverse edge 142 of the first insert member 28 when viewed along a vertical axis. A forward edge 154 may extend between the top lateral edge 151 and the bottom lateral edge 150, and the forward edge 154 may be disposed between (e.g., a midpoint between) the first end 30 and the second end 32 of the first insert member 28 when viewed along a vertical axis. A top portion of the insert linkage arm 41 adjacent to the second end 45 may be secured to the pivot assembly 40 that is itself secured to the first insert member 28 by the pin 149. The top portion of the insert linkage arm 41 adjacent to the second end 45 may be secured to the pivot assembly 40 by any means known in the art. For example, the top portion of the insert linkage arm 41 adjacent to the second end 45 may be welded or mechanically fastened to a bottom portion of the second plate 140 and/or to a portion of the bottom wall 142 of the pivot assembly 40. So secured, a gap may exist between an inner surface 145 (i.e., a surface facing the second surface 114 of the first insert member 28) and the second surface 114 of the first insert member 28, as illustrated in FIG. 1B.

Referring to FIGS. 1B and 18, the second end 20 of the first linkage arm 16 may be pivotably coupled to a first portion of the insert linkage arm 41 and the second end 26 of the second linkage arm 22 may be pivotably coupled to a second portion of the insert linkage arm 41. For example, the second end 20 of the first linkage arm 16 may be pivotably coupled to the insert linkage arm 41 adjacent to the second end 45 of the insert linkage arm 41 and the second end 26 of the second linkage arm 22 may be pivotably coupled to the insert linkage arm 41 adjacent to the first end 43 of the insert linkage arm 41. The second ends 20, 26 of each of the first and second linkage arms 16, 22 may be pivotably coupled to the insert linkage arm 41 in any manner known in the art. For example, a pin 133 may be disposed through corresponding apertures 139*a*, 139*b* (illustrated in FIG. 6) formed through the first portion and second portion of the insert linkage arm 41 such that each of the first linkage arm 16 and the second linkage arm 22 is pivotable about a corresponding pin 133. The second ends 20, 26 of each of the first and second linkage arms 16, 22 may be pivotably coupled to the insert linkage arm 41 at the manufacturing facility or at any time prior to shipping the unassembled product to a retail outlet or to an end-user.

Figure 9:
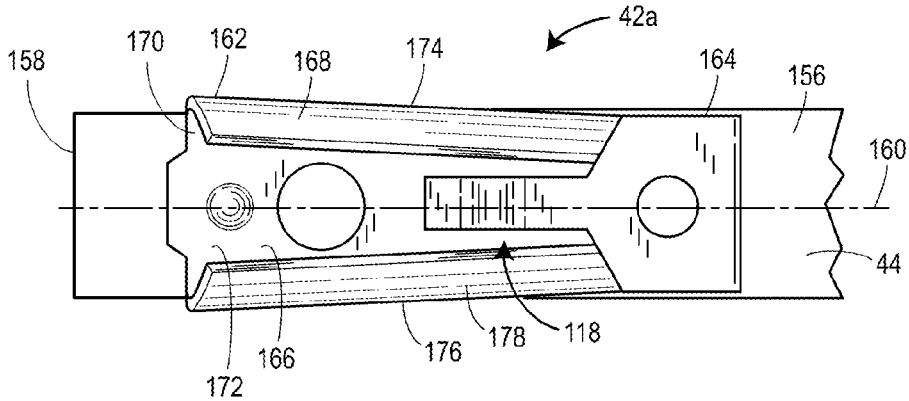
FIG. 9 is a front plan view of a first rear receiver member.
Figure 10A:
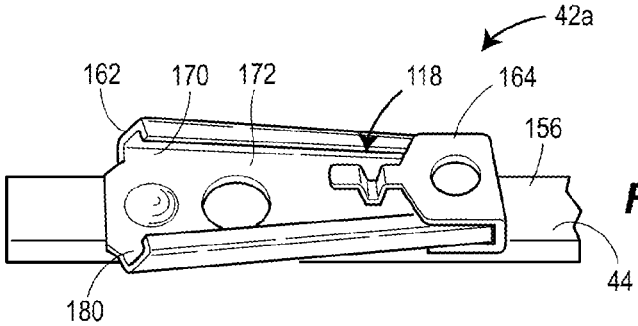
FIG. 10A is an isometric view of the first rear receiver member illustrated in FIG. 9.
Figure 13:
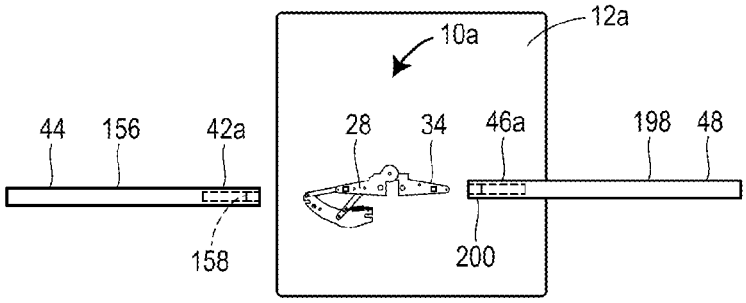
FIG. 13 is a front plan view of a furniture sidewall and the embodiment of the hinge assembly illustrated in FIG. 1A with a first furniture portion and a second furniture portion aligned with the first insert member and the second insert member, respectively.

Referring to FIGS. 9, 10A, 13, and 14, the hinge assembly 10*a* may include a first rear receiving member 42*a* secured to the first furniture portion 44 (which may be a seat back portion of a convertible sofa), and the first rear receiving member 42*a* may be adapted to receive a portion of the first insert member 28 to releasably secure the first insert member 28 to the first rear receiving member 42*a*, as illustrated in FIGS. 13 and 14. The first rear receiving member 42*a* may be disposed on a first lateral member 156 at or adjacent to a first end 158 of the first lateral member 156. Referring to FIGS. 9 and 10A, the first rear receiving member 42*a* may be elongated and may extend along a longitudinal axis 160 such that the first rear receiving member 42*a* includes a first end 162 and a second end 164 longitudinally opposite the first end 162. The longitudinal axis 160 may be aligned with a longitudinal axis of the first lateral member 156 of the first furniture portion 44, and the first end 162 of the first rear receiving member 42*a* may be at or adjacent to the first end 158 of the first lateral member 156.

Still referring to FIGS. 9 and 10A, the first rear receiving member 42*a* may include a base 166 that is secured to the first lateral member 156 by any manner known in the art, such as welding or mechanical fastening. The base 166 may be planar and may be defined by a first lateral edge 174 and a second lateral edge 176 that extend from the first end 162 to the second end 164, and the first lateral edge 174 and the second lateral edge 176 may each converge towards the longitudinal axis 160 as the first lateral edge 174 and the second lateral edge 176 each extends from the first end 162 towards the second end 164. The first lateral edge 174 and the second lateral edge 176 may be linear or substantially linear, or the first lateral edge 174 and the second lateral edge 176 may be curved relative to the longitudinal axis 160. The first lateral edge 174 and the second lateral edge 176 may be symmetrical or substantially symmetrical about the longitudinal axis 160. However, the first lateral edge 174 and the second lateral edge 176 (or portions of one or both of the first lateral edge 174 and the second lateral edge 176) may be asymmetrical about the longitudinal axis 160.

Figure 11A:
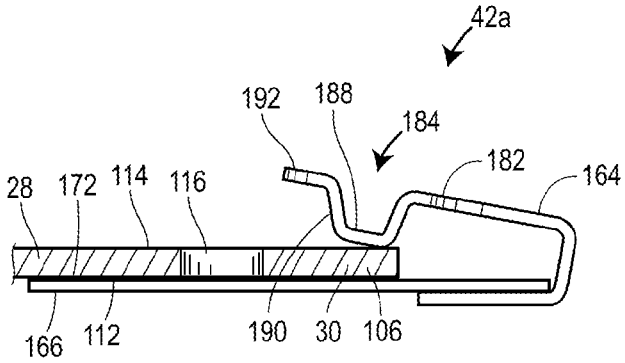
FIG. 11A is a partial cross-sectional side view of the first insert member partially inserted into the first rear receiver member illustrated in FIG. 9.
Figure 11B:
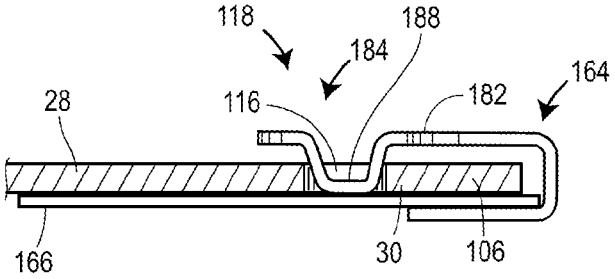
FIG. 11B is a partial cross-sectional side view of the first insert member completely inserted into the first rear receiver member illustrated in FIG. 9.

A first lip portion 168 may inwardly extend from the first lateral edge 174 to form a first groove 170 between an inner surface of the first lip portion 168 and a top surface 172 of the base 166. A second lip portion 178 may inwardly extend from the second lateral edge 176 to form a second groove 180 between an inner surface of the second lip portion 178 and the top surface 172 of the base 166, and the first lip portion 168 and the second lip portion 178 may be symmetrically formed about the longitudinal axis 160. The first groove 170 may be adapted to receive a longitudinal portion of the first insert member 28 adjacent to (and along) the first lateral edge 102 and the second groove 180 may be adapted to receive a longitudinal portion of the first insert member 28 adjacent to (and along) the second lateral edge 104. With the first insert member 28 inserted into the first rear receiving member 42*a* (i.e., when the longitudinal axis 100 of the first insert member 28 is aligned with the longitudinal axis 160 of the first rear receiving member 42*a* and, as illustrated in FIG. 11B, a portion of the first surface 112 of the first insert member 28 is adjacent to or in contact with a portion of the top surface 172 of the base 160 of the first rear receiving member 42*a*, and when a portion of the locking tab 118 engages the locking aperture 116), an inward edge of the first lip portion 168 may be disposed closer to the longitudinal axis 100 of the first insert member 28 (when viewed along a vertical axis) than the first lateral edge 102 of the first insert member 28 and an inward edge of the second lip portion 178 may be disposed closer to the longitudinal axis 100 of the first insert member 28 (when viewed along a vertical axis) than the second lateral edge 104 of the first insert member 28. So configured, the first and second grooves 170, 180 act as a guide to ensure that a portion of the locking tab 118 properly engages the locking aperture 116 during coupling of the first insert member 28 and the first rear receiving member 42*a*. One having ordinary skill in the art would recognize that this configuration prevents the first insert member 28 from being vertically separated from the first rear receiving member 42*a*, but also allows for an end user to access the locking tab 118 to disengage the first insert member 28 form the first rear receiving member 42*a* in a manner that will be described in greater detail below.

Figure 10B:
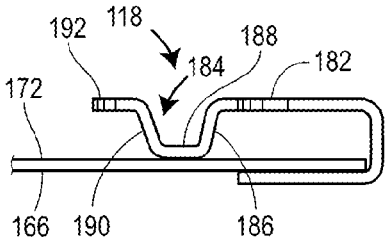
FIG. 10B is a partial cross-sectional side view taken along the longitudinal axis of the first rear receiver member illustrated in FIG. 9.

As Illustrated in FIGS. 9, 10A, and 10B, the first rear receiving member 42*a* may include the locking tab 118. The locking tab 118 may be a one-piece assembly that may be coupled to the base 166 at or adjacent to the second end 164 of the first rear receiving member 42*a*. Referring to FIG. 10B, the locking tab 118 may include a spring portion 182 and an engagement portion 184 that is adapted to be aligned with the locking aperture 116 of the first insert member 28 when the first insert member 28 is inserted into the first rear receiving member 42*a*. Specifically, the spring portion 182 may be a cantilevered leaf spring that is offset from the top surface 172 of the base 166, and the engagement portion 184 may be feature at the terminal end of the spring portion 182. The engagement portion 184 may include an oblique transition portion 186 and a bottom portion 188 that may be planar or substantially planar. The bottom portion 188 may be dimensioned to be received into the locking aperture 116 of the first insert member 28. For example, if the locking aperture 116 has a length and a width dimension, the bottom portion 188 may have a length and a width dimension that is each slightly less than the corresponding length and width dimensions of the locking aperture 116. A second oblique transition portion 190 may extend from the bottom portion 188, and a release tab 192 may extend from the terminal end of the second oblique transition portion 190. The cantilevered spring portion 182 may bias the bottom portion 188 of the engagement portion 184 into contact with (or into a position immediately adjacent to) the top surface 172 of the base 166.

To insert the first insert member 28 into the first rear receiving member 42*a*, the longitudinal axis 100 of the first insert member 28 is aligned with the longitudinal axis 160 of the first rear receiving member 42*a* and a portion of the first surface 112 of the first insert member 28 is adjacent to or in contact with a portion of the top surface 172 of the base 160 of the first rear receiving member 42*a*. The nose portion 106 of the first insert member 28 is displaced towards the second end 164 of the first rear receiving member 42*a* until the nose edge 102 contacts the second oblique transition portion 190 adjacent to the bottom portion 188. Further longitudinal displacement of the first insert member 28 causes the engagement portion 184 to displace away from the top surface 172 such that the bottom portion 188 is biased into contact with the first surface 112 of the first insert member 28 upon further longitudinal displacement, as illustrated in FIG. 11A. When the first insert member 28 is displaced a predetermined distance into the first rear receiving member 42*a* (as illustrated in FIG. 11B), all or a portion of the bottom portion 188 of the engagement portion 184 may be received into the locking aperture 116 of the first insert member 28 due to the force exerted by the cantilevered spring portion 182, thus preventing further longitudinal displacement of the first insert member 28 towards the second end 164 of the first rear receiving member 42*a*. Accordingly, the first insert member 28 may be secured to the first lateral member 156 of the first furniture portion 44 by inserting the first insert member 28 into the first rear receiving member 42*a* and displacing the first insert member 28 a predetermined distance towards the second end 164 of the first rear receiving member 42*a*.

To disengage the first insert member 28 from the first rear receiving member 42*a*, the release tab 192 may be displaced away from the first insert member 28 such that the bottom portion 188 of the engagement portion 184 is no longer received into the locking aperture 116 of the first insert member 28. At the same time, the first insert member 28 may be longitudinally displaced away from the second end 164 of the first rear receiving member 42*a* until the first insert member 28 is completely removed from the first rear receiving member 42*a*.

As illustrated in FIG. 15, a second hinge assembly 10*b*, that is a minor image of (but otherwise identical to) the first hinge assembly 10*a*, may be secured to a second furniture sidewall 12*b*. Referring to FIGS. 14 and 15, the second hinge assembly 10*b* secured to the second furniture sidewall 12*b* may include a second rear receiving member 42*b* secured to a second lateral member 194 of the first furniture portion 44 at or adjacent to a first end 196 of the first lateral member 194. The second rear receiving member 42*b* may be identical or substantially identical to the first rear receiving member 42*a*, and the first insert member 28 of the second hinge assembly 10*b* may be engaged and disengaged from the second rear receiving member 42*b* in the same manner that the first insert member 28 of the first hinge assembly 10*a* is engaged and disengaged from the first rear receiving member 42*a*. Accordingly, the first furniture portion 44 (having a first rear receiving member 42*a* and a second rear receiving member 42*b*) may be releasably secured to the first insert member 28 of each of the first and second hinge assemblies 10*a*, 10*b*, respectively, to releasably and pivotably secure the first furniture portion 44 to the first furniture sidewall 12*a* and the second furniture sidewall 12*b*.

Referring to FIGS. 13 and 14, the first hinge assembly 10*a* secured to the first furniture sidewall 12*a* may include a first front receiving member 46*a* secured to the second furniture portion 48 (which may be a seat bottom portion of a convertible sofa), and the first front receiving member 46*a* may be adapted to receive a portion of the second insert member 34 to releasably secure the second insert member 34 to the first front receiving member 46*a*. The first front receiving member 46*a* may be disposed on a first lateral member 198 at or adjacent to a first end 200 of the first lateral member 198. The first front receiving member 46*a* may be identical or substantially identical to the first rear receiving member 42*a*, and the second insert member 34 of the first hinge assembly 10*a* may be engaged and disengaged from the first front receiving member 46*a* in the same manner that the first insert member 28 of the first hinge assembly 10*a* is engaged and disengaged from the first rear receiving member 42*a*. However, if the second insert member 34 has slight dimensional differences from the first insert member 28, one having ordinary skill in the art would recognize that the first front receiving member 46*a* may have corresponding dimensional differences to the first rear receiving member 42*a* to accommodate the second insert member 34.

Referring to FIGS. 14 and 15, the second hinge assembly 10*b* secured to the second furniture sidewall 12*b* may include a second front receiving member 46*b* secured to a second lateral member 202 of the second furniture portion 48 at or adjacent to a first end 204 of the second lateral member 202. The second front receiving member 46*b* may be identical or substantially identical to the first rear receiving member 42*a* (or the second front receiving member 46*b* may have slight dimensional differences from the first rear receiving member 42*a*, as discussed above), and the second insert member 34 of the second hinge assembly 10*b* may be engaged and disengaged from the second front receiving member 46*b* in the same manner that the first insert member 28 of the first hinge assembly 10*a* is engaged and disengaged from the first rear receiving member 42*a*. Accordingly, the second furniture portion 48 (having a first front receiving member 46*a* and a second front receiving member 46*b*) may be releasably secured to the second insert member 34 of each of the first and second hinge assemblies 10*a*, 10*b*, respectively, to releasably and pivotably secure the second furniture portion 48 to the first furniture sidewall 12*a* and the second furniture sidewall 12*b*.

The linkage base 14, first linkage arm 16, second linkage arm 22, first insert member 28, second insert member 34, pivot assembly 40, first and second rear receiving members 42*a*, 42*b*, and first and second front receiving members 46*a*, 46*b* may each be made from any suitable materials or combination of materials. For example, these components may be made from steel or a steel alloy that may be stamped and formed as appropriate.

As illustrated in FIGS. 1A, 14 and 15, with the first furniture sidewall 12*a* and the second furniture sidewall 12*a* mutually secured by one or more transverse members (not shown) that may be assembled by the end user without the use of tools, the first insert member 28 and the second insert member 34 may be initially positioned in a first position 50 (i.e., a position in which the longitudinal axis 100 the first insert member 28 is parallel to or collinear with the longitudinal axis 120 the second insert member 34). In this first position 50, the first furniture portion 44 (which may be a seat back portion of a convertible sofa) and the second furniture portion 48 (which may be a seat bottom portion of a convertible sofa) may be coupled to the first hinge assembly 10*a* and the second hinge assembly 10*b* as previously described. Instead of being parallel or collinear, the longitudinal axis 100 the first insert member 28 may form an angle within the range of 170° to 190° with the longitudinal axis 120 the second insert member 34. Subsequently, cushions 206 may be attached or secured to each of the first furniture portion 44 and the second furniture portion 48. So configured, the first furniture portion 44 and the second furniture portion 48 are in a first position (e.g., a sleeping position) are substantially aligned in the same plane to form a sleeping surface (i.e., a position in which the longitudinal axis 100 the first insert member 28 is parallel to or collinear with the longitudinal axis 120 the first insert member 28), as illustrated in FIG. 16.

The first furniture portion 44 and the second furniture portion 48 may be converted to a second position (e.g., a sitting position) in which the first furniture portion 44 and the second furniture portion 48 are disposed at a right (or an obtuse) angle to form a seating position, as illustrated in FIG. 17. Such a position corresponds to the second position 52 illustrated in FIG. 12, in which the longitudinal axis 100 of the first insert member 28 is obliquely disposed (or disposed at a right angle) relative to the longitudinal axis 120 of the second insert member 34. For example, the longitudinal axis 100 of the first insert member 28 may form an angle between 80° and 130° with the longitudinal axis 120 of the second insert member 34.

The locking mechanism of the pivot assembly 40 may allow for a third position in which the longitudinal axis 100 the first insert member 28 is disposed at an oblique, obtuse, or right angle relative to the longitudinal axis 120 of the second insert member 34 that is different than the angle of the second position 52. In fact, the locking mechanism of the pivot assembly 40 may allow for any number of positions in which the first insert member 28 is disposed at an oblique, obtuse, or right angle relative to the longitudinal axis 120 of the second insert member 34.

To move the first and second hinge assemblies 10*a*, 10*b* from the first position 50 to the second position 52, the second furniture portion 48 (illustrated in FIG. 16) may be rotated towards the first furniture portion 44 until the locking mechanism of the pivot assembly 40 is automatically engaged, thereby locking the first insert member 28 relative to the second insert member 34. While locked, the second furniture portion 48 may be downwardly rotated such that the first linkage arm 16 and the second linkage arm 22 of each of the first and second hinge assemblies 10*a*, 10*b* are pivoted about the first portion and the second portion, respectively, of the linkage base 14 (which is a counterclockwise rotation in FIG. 1A). The coil spring 74 secured to the linkage base 14 and the first linkage arm 16 opposes this rotation, and thereby provides assistance to the user when the process is reversed to convert the sofa from the second position 52 to the first position 50. The four-bar linkage provided by the insert linkage arm 41, the first linkage arm 16, the second linkage arm 22, and the linkage base 14 maintains the first insert member 28 and the second insert member 34 in a proper orientation when moving from the first position 50 to the second position 52 (and vice versa). Additionally, when in the second position 52, an intermediate portion of the second linkage arm 22 contacts the first linkage arm 16 at or adjacent to the second end 20 to prevent further counterclockwise rotational displacement of the first linkage arm 16 and the second linkage arm 22.

To move the first and second hinge assemblies 10*a*, 10*b* from the second position 52 (or the third position, fourth position, etc.) to the first position 50, the second furniture portion 48 may pulled towards the user and pivoted towards the first furniture portion 44 to unlock the locking mechanism and to pivot the first linkage arm 16 and the second linkage arm 22 in a clockwise direction. The second furniture portion 48 may then be rotated away from the first furniture portion 44 and into the sleeping position illustrated in FIG. 16.

Configured as described, one having ordinary skill in the art would recognize that the hinge assembly 10*a*, 10*b* may provide for a convertible sofa that is assembled by an end-user without tools, the hinge assemblies 10*a*, 10*b* of the convertible sofa having a first position 50 in which the first furniture portion 44 and the second furniture portion 48 are substantially aligned in the same plane to form a sleeping position and a second position 52 in which the first furniture portion 44 and the second furniture portion 48 are disposed at a right (or an obtuse) angle to form a seating position.

While various embodiments have been described above, this disclosure is not intended to be limited thereto. Variations can be made to the disclosed embodiments that are still within the scope of the appended claims. For example, while embodiments of a convertible sofa have been disclosed, one having ordinary skill in the art would recognize that the disclosed hinge assembly 10*a*, 10*b* may be used with any suitable type of furniture that may be assembled by an end-user without the use of tools.

What is claimed is:

1. A hinge assembly adapted to be coupled to a furniture sidewall, the hinge assembly comprising:

a linkage base adapted to be secured to a portion of the furniture sidewall;

an elongate first linkage arm having a first end and a second end opposite the first end;

an elongate second linkage arm having a first end and a second end opposite the first end;

an insert member assembly comprising:

an elongate first insert member having a first end and a second end opposite the first end;

an elongate second insert member having a first end and a second end opposite the first end;

a pivot assembly disposed adjacent to the second end of the first insert member and the second end of the second insert member such that the hinge member pivotably couples the first insert member and the second insert member; and an insert linkage arm having a first end and a second end opposite the first end, the insert linkage arm being coupled to the first insert member, wherein the first end of the first linkage arm is pivotably coupled to a first portion of the linkage base and the second end of the first linkage arm is pivotably coupled to a first portion of the insert linkage arm, and wherein the first end of the second linkage arm is pivotably coupled to a second portion of the linkage base and the second end of the second linkage arm is pivotably coupled to a second portion of the insert linkage arm.

2. The hinge assembly of claim 1, wherein the first insert member is adapted to be releasably secured within a first receiving member secured to a first furniture portion and the second insert member is adapted to be releasably secured within a first rear receiving member secured to a second furniture portion.

3. The hinge assembly of claim 1, wherein in a first hinge position, a longitudinal axis extending from the first end of the first insert member to the second end is collinear with or parallel to a longitudinal axis extending from the first end of the second insert member to the second end.

4. The hinge assembly of claim 3, wherein in a second hinge position, the longitudinal axis of the first insert member is obliquely disposed relative to the longitudinal axis of the second insert member.

5. The hinge assembly of claim 4, wherein in the second hinge position, the longitudinal axis of the first insert member is disposed at an angle between 80 degrees and 120 degrees relative to the longitudinal axis of the second insert member.

6. The hinge assembly of claim 1, wherein the linkage base has a first end, a second end opposite the first end, and an intermediate portion disposed between the first end and the second end.

7. The hinge assembly of claim 6, wherein the first portion of the linkage base is adjacent to the intermediate portion of the linkage base and the second portion of the linkage base is adjacent to the second end of the linkage base.

8. The hinge assembly of claim 1, further comprising a coil spring coupled to the linkage base and the first linkage arm.

9. A furniture assembly comprising:

a first hinge assembly coupled to a first furniture sidewall, the first hinge assembly comprising:

a linkage base secured to a portion of the furniture sidewall;

an elongate first linkage arm having a first end and a second end opposite the first end;

an elongate second linkage arm having a first end and a second end opposite the first end;

an insert member assembly comprising:

an elongate first insert member having a first end and a second end opposite the first end; and an elongate second insert member having a first end and a second end opposite the first end;

a pivot assembly disposed adjacent to the second end of the first insert member and the second end of the second insert member such that the hinge member pivotably couples the first insert member and the second insert member; and an insert linkage arm having a first end and a second end opposite the first end, the insert linkage arm being coupled to the first insert member, wherein the first end of the first linkage arm is pivotably coupled to a first portion of the linkage base and the second end of the first linkage arm is pivotably coupled to a first portion of the insert linkage arm, and wherein the first end of the second linkage arm is pivotably coupled to a second portion of the linkage base and the second end of the second linkage arm is pivotably coupled to a second portion of the insert linkage arm;

a first furniture portion having a first front receiving member that is adapted to releasably receive the first insert member to releasably secure the first furniture portion to the first furniture sidewall; and a second furniture portion having a first rear receiving member that is adapted to releasably receive the second insert member to releasably secure the second furniture portion to the first furniture sidewall.

10. The furniture assembly of claim 9, wherein in a first hinge position, a longitudinal axis extending from the first end of the first insert member to the second end is collinear with or parallel to a longitudinal axis extending from the first end of the second insert member to the second end.

11. The furniture assembly of claim 10, wherein in a second hinge position, the longitudinal axis of the first insert member is obliquely disposed or disposed at a right angle relative to the longitudinal axis of the second insert member.

12. The furniture assembly of claim 11, wherein in the second hinge position, the longitudinal axis of the first insert member is disposed at an angle between 80 degrees and 120 degrees relative to the longitudinal axis of the second insert member.

13. The furniture assembly of claim 9, wherein the linkage base has a first end, a second end opposite the first end, and an intermediate portion disposed between the first end and the second end.

14. The furniture assembly of claim 13, wherein the first portion of the linkage base is adjacent to the intermediate portion of the linkage base and the second portion of the linkage base is adjacent to the second end of the linkage base.

15. The furniture assembly of claim 9, further comprising a second hinge assembly adapted to be coupled to a second furniture sidewall, the second hinge assembly comprising:

a linkage base adapted to be secured to a portion of the second furniture sidewall;

an elongate first linkage arm having a first end and a second end opposite the first end;

an elongate second linkage arm having a first end and a second end opposite the first end;

an insert member assembly comprising:

an elongate first insert member having a first end and a second end opposite the first end;

an elongate second insert member having a first end and a second end opposite the first end;

a pivot assembly disposed adjacent to the second end of the first insert member and the second end of the second insert member such that the hinge member pivotably couples the first insert member and the second insert member; and an insert linkage arm having a first end and a second end opposite the first end, the insert linkage arm being coupled to the first insert member, wherein the first end of the first linkage arm is pivotably coupled to a first portion of the linkage base and the second end of the first linkage arm is pivotably coupled to a first portion of the insert linkage arm, and wherein the first end of the second linkage arm is pivotably coupled to a second portion of the linkage base and the second end of the second linkage arm is pivotably coupled to a second portion of the insert linkage arm;

the first furniture portion having a second front receiving member that is adapted to releasably receive the first insert member of the second hinge assembly to releasably secure the first furniture portion to the second furniture sidewall; and the second furniture portion having a second rear receiving member that is adapted to releasably receive the second insert member of the second hinge assembly to releasably secure the second furniture portion to the second furniture sidewall.

16. The furniture assembly of claim 15, wherein in a first hinge position of the second hinge assembly, a longitudinal axis extending from the first end of the first insert member to the second end is collinear with or parallel to a longitudinal axis extending from the first end of the second insert member to the second end.

17. The furniture assembly of claim 15, wherein in a second hinge position of the second hinge assembly, the longitudinal axis of the first insert member is obliquely disposed relative to the longitudinal axis of the second insert member, and the angle between the longitudinal axis of the first insert member and the longitudinal axis of the second insert member is identical to the angle between the longitudinal axis of the first insert member of the first hinge assembly and the longitudinal axis of the second insert member of the first hinge assembly in the first hinge position of the first hinge assembly.

18. A method of providing a disassembled article of furniture, the method comprising:

coupling a first insert member and a second insert member of a first hinge assembly to a first furniture sidewall such that each of the first and second insert members is pivotable about a first pivot axis;

coupling a first insert member and a second insert member of a second hinge assembly to a second furniture sidewall such that each of the first and second insert members is pivotable about a second pivot axis that is adapted to be coaxially aligned with the first pivot axis;

providing a first furniture portion having a first rear receiving member and a second rear receiving member coupled thereto, the first rear receiving member and the second rear receiving member adapted to be releasably coupled to the first insert member of each of the first and second insert members such that the first furniture portion is rotatable about the first and second pivot axes; and providing a second furniture portion having a first front receiving member and a second front receiving member coupled thereto, the first front receiving member and the second front receiving member adapted to be releasably coupled to the second insert member of each of the first and second insert members such that the first furniture portion is rotatable about the first and second pivot axes.

19. The method of claim 18, wherein the first insert member of each of the first and second hinge assemblies is configured to be inserted into each of the first rear receiving member and the second rear receiving member such that an automatic locking mechanism secures the first insert members within each of the first rear receiving member and the second rear receiving member, and wherein the second insert member of each of the first and second hinge assemblies is configured to be inserted into each of the first front receiving member and the second front receiving member such that an automatic locking mechanism secures the first insert members within each of the first front receiving member and the second front receiving member.

20. The method of claim 19, wherein the automatic locking mechanisms each include a leaf spring having a portion of an engagement portion that is biased into a corresponding aperture formed on each of the first and second insert arms of the first and second hinge assemblies.

* * * * *